United States Patent [19]

Bähre

[11] 4,158,298

[45] Jun. 19, 1979

[54] DEVICE FOR CONTINUOUS WET TREATMENT OF TEXTILE WEBS

[75] Inventor: Gerhard W. Bähre, Bendestorf, Fed. Rep. of Germany

[73] Assignee: Artos Dr.-Ing. Meier-Windhorst KG (GmbH & Co.), Hittfelder Kirchweg, Fed. Rep. of Germany

[21] Appl. No.: 877,458

[22] Filed: Feb. 13, 1978

[30] Foreign Application Priority Data

Feb. 11, 1977 [DE] Fed. Rep. of Germany ..... 2705761

[51] Int. Cl.[2] ..... D06B 3/10

[52] U.S. Cl. ..... 68/43; 26/21; 28/263; 28/267; 68/128; 68/177; 68/207

[58] Field of Search ..... 68/43, 44, 177, 207, 68/128, 270; 100/174; 26/21; 28/263, 267

[56] References Cited

U.S. PATENT DOCUMENTS

| | | | |
|---|---|---|---|
| 1,999,317 | 4/1935 | Brix | 68/177 X |
| 2,575,838 | 11/1951 | Rainard | 28/267 X |
| 2,849,784 | 9/1958 | Adams | 68/43 X |
| 3,475,927 | 11/1969 | Bertoldi | 68/43 X |
| 3,720,080 | 3/1973 | Grantham | 68/44 X |
| 3,955,255 | 5/1976 | Shields | 28/267 |
| 4,078,403 | 3/1978 | Kutz et al. | 68/43 |

FOREIGN PATENT DOCUMENTS 641811 2/1937 Fed. Rep. of Germany ..... 26/21

*Primary Examiner*—Philip R. Coe

*Attorney, Agent, or Firm*—Allison C. Collard; Thomas M. Galgano

[57] ABSTRACT

A device is provided for the continuous treatment of relatively wide textile webs in a treatment medium, wherein the web and the treatment medium move through a trough having squeezing rollers associated therewith for intensifying the treatment of the web with the treatment medium and wherein a funnel-shaped diffuser is disposed at the entrance end of the trough for introducing the web of material into the trough. The device includes squeezing means which are disposed adjacent to the diffuser means and which include a pair of coacting, rotatable squeeze rollers which define therebetween a squeezing nip disposed beneath the surface of the treatment medium and through which the web passes prior to introduction into the diffuser. Deflection means are also provided which are disposed adjacent to the discharge end of the nip of the rollers for facilitating removal of the web from engagement with the circumferential surface of the rollers and for guiding the web into the trough.

8 Claims, 5 Drawing Figures

DEVICE FOR CONTINUOUS WET TREATMENT OF TEXTILE WEBS

The present invention relates to a device for the continuous treatment of webs, in particular, wide textile webs, in a treatment medium. More particularly, it relates to such a device, wherein the web of material and the treatment liquid preferably move in the same direction through a trough having squeezing rollers for intensifying the treatment of the web with the treatment liquid and, wherein a funnel-shaped diffuser is provided at the starting end of the trough for introducing the web of material into the trough.

It is already known to subject wide webs of material to a liquid treatment in shallow troughs, whereby an intensification of the treatment of the web of material with the treatment solution is carried out by means of squeezing or moving elements. Such a treatment device requires a correct introduction of the web of material into the device. This is of utmost importance for the proper functioning of such a device. When introducing the web of material into the treatment device, it is essential to achieve an even distribution of the web of material in the treatment medium. On the other hand, it is necessary to prevent the web of material from floating on the surface of the treatment medium as a result of air pockets which may be present in the trough.

Devices are already provided for ensuring a safe introduction of the web of material into the treatment solution by providing a funnel-shaped insertion means and suitable means for feeding of the treatment solution. However, the speed of the treatment flow is limited by the speed of the web of material, so that the problems of air pockets which occur when introducing the web of material into the treatment liquid has not yet been adequately solved, especially when treating light-weight materials.

It is, therefore, an object of the present invention to provide a de-aeration and a forced positive guidance of the web of material before the material is introduced into the treatment trough of devices of the type described above. Furthermore, a trouble-free introduction of the web of material into the trough should be ensured, even with high web speeds of greater than 50 m/min.

This object of the invention is obtained in that a diffuser is provided in the treatment device having a preferably vertically-arranged pair of squeezing elements or rollers which cooperate to define a squeezing nip which is positioned beneath the surface level of the treatment liquid. The diffuser is provided with deflection elements for the web of material which are positioned adjacent to the circumference of the squeezing rollers where the web of material is discharged, i.e., adjacent to the discharge side of the nip defined between the squeezing rollers. This deflection of the web of material from the circumference of the squeezing rollers is of particular importance when treating light material, because these type of materials have the tendency to cling to the circumference of the squeezing rollers due to the treatment liquid which penetrates through the web of material. Normally, such deflection devices may be simple wipers which engage in tight engagement against the circumference of the squeezing rollers. It had been found advantageous to use the ends of the upper and lower housing walls of the diffuser supported by outwardly disposed sealing bars, to act as the wipers. In this manner, no additional wiping elements are required.

In difficult to treat webs of material, i.e., very light materials, it is still possible that the web of material may cling to the surface of the squeezing rollers as a result of which they may be pulled pass the sealing bars outwardly of the diffuser. In order to prevent this, the deflection elements may be bands, belts or the like which run together with the squeezing rollers or are driven over auxiliary rollers. Since these very stable belts are running around the rollers, they take up the web of material and reintroduce the web back into the diffuser. Hence, such belts acting as the deflection elements may be belts which run across the total width of the rollers. This may only be possible with relatively small width webs of material, so as to ensure an interference-free operation. However, in wide web materials, these belts may be provided and distributed as a plurality of smaller belts over the total width of the rollers and may run in recesses of the squeezing rollers in a manner that the belts have the same cross-section as the roller jackets. In other words, the belts should be flush with the roller surface.

It had been shown that it is advantageous to position the bearing pin of the lower squeezing roller through the housing and into outer bearings. The bearings for the upper support squeezing roller, which preferably should be a hardcore roller, may be mounted in the treatment liquid in the form of slide bearings. In this way, the bearings can be easily displaced so as to permit disengagement of the upper roller from the lower roller, such as by hydraulic means. It is also advantageous to provide supply means for introducing fresh liquid immediately following the squeezing elements which facilitates an orderly introduction of the web of material into the trough. The inventive device is characterized in that, due to the forced positive introduction of the web of material into the device and that due to the de-aeration of the web of material, a speed independency is obtained which permits substantially high speeds for the web of material. Due to the exact packing position, a perfect feeding of the web is obtained without a lateral swimming within the trough. The feeding of the web of material is also substantially independent from the flow direction of the treatment medium, so that the web of material may be treated with a countercurrent treatment.

Other objects and features of the present invention will become apparent from the following detailed descriptions when taken in connection with the accompanying drawings which discloses several embodiments of the invention. It is to be understood that the drawings are designed for the purpose of illustration only, and are not intended as a definition of the limits and scope of the invention disclosed.

In the drawings, wherein similar reference numerals denote similar elements throughout the several views.

Figure 1:
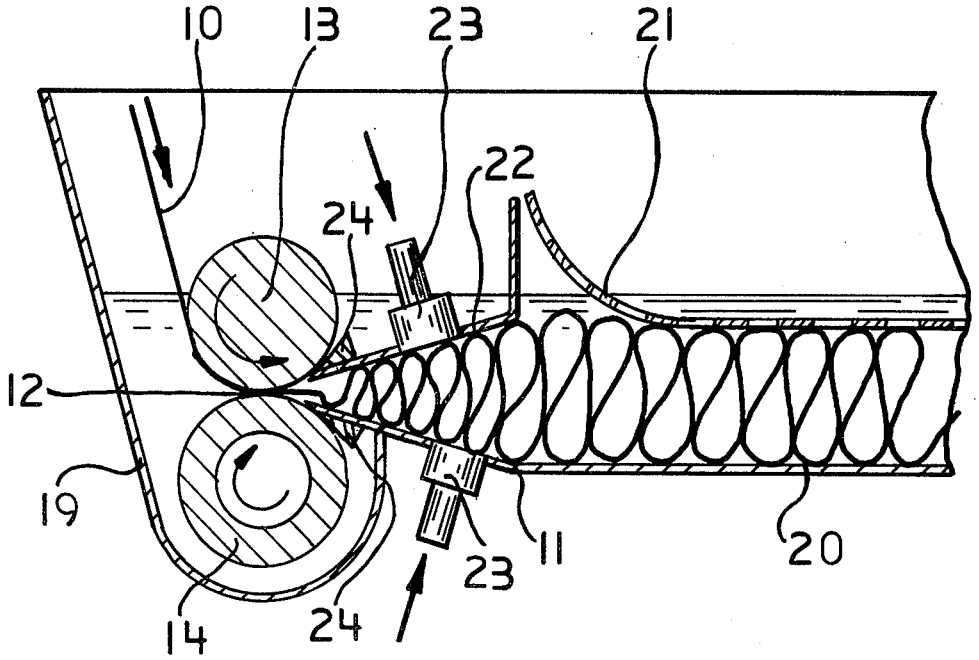
FIG. 1 is a side sectional view of one embodiment of the inventive device, wherein the wiper elements are provided by the ends of the upper and lower walls of the diffuser.
Figure 2:
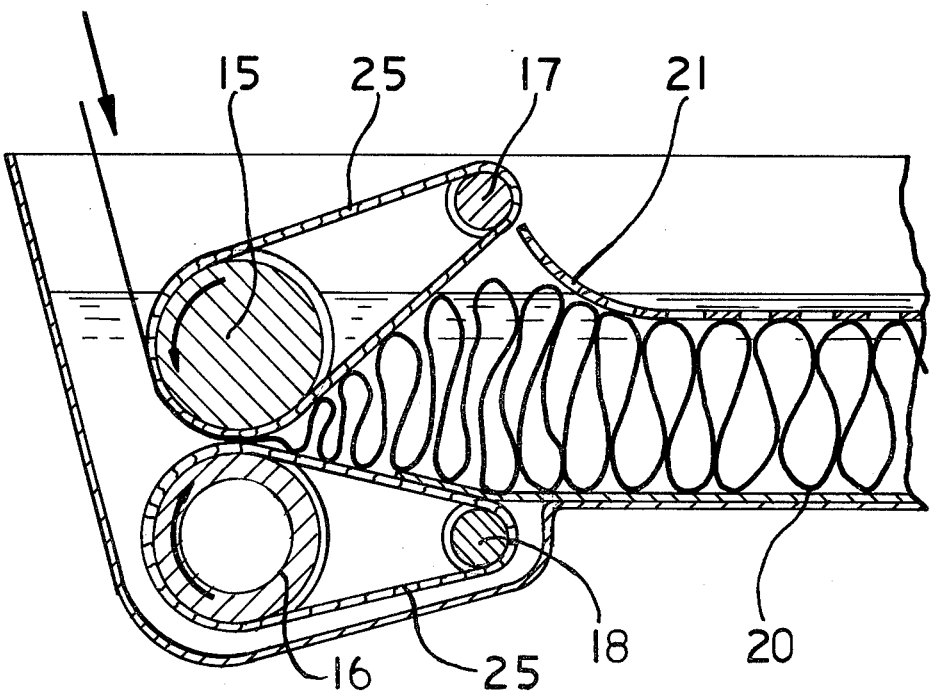
FIG. 2 is a side sectional view of a further embodiment of the invention, wherein the rotating belts serve as the wiping elements.

As can be seen, in particular, from FIGS. 1 and 2, squeezing means including a pair of cooperating squeezing rollers 13, 14, or 15,16, respectively, are arranged in a vertical disposition, one atop another, and are submerged in a container 19 which is positioned in front of a treatment trough 20 for treating a web of material 10. Thereby, the nip 12 of each pair of squeezing rollers 13, 14, or 15, 16 is submerged in the treatment liquid. In FIG. 1, a funnel-shaped diffuser including an upper wall 22 and a lower wall 11 is disposed adjacent to the squeezing means such that the web of material 10 moves from the squeezing nip 12 between lower wall 11 and upper wall 22 of the diffuser and subsequently into trough 20. The web material floats through the treatment liquid and is subjected to squeezing elements 21 or the like. Above the upper diffuser wall 22 and below diffuser wall 11, openings 23 are provided for feeding the fresh treatment liquid through the diffuser walls and into trough 20. This type of feeding of the treatment liquid supports the introduction of the web of material into trough 20. In the illustrated embodiment of FIG. 1, the end portions of the upper wall 22 and the lower wall 11 adjacent to squeeze rollers 13, 14, serve as deflection devices or wipers for guiding the web from the nip 12 into trough 20. Sealing bars 24 are mounted between these walls and the surface of the rollers which can be optimally adjusted on the rollers, so as to keep the friction forces as low as possible.

Figure 4:
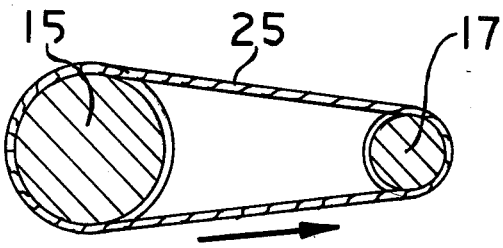
FIG. 4 is a side view showing the arrangement of the wiper belt on one squeezing roller and cooperating auxiliary roller.
Figure 5:
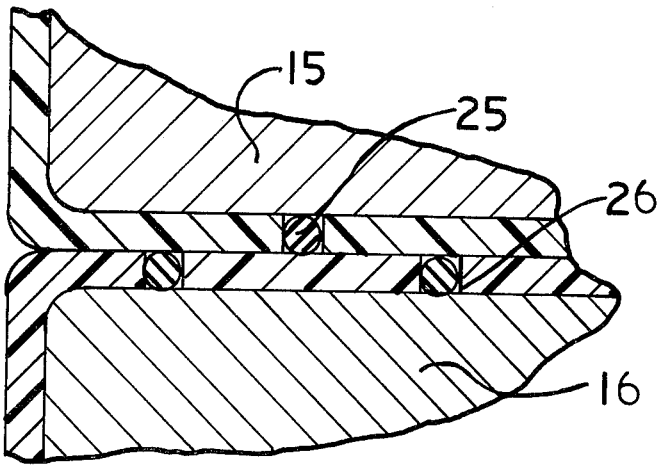
FIG. 5 is a sectional view showing the disposition of the belts as they pass through the nip between the squeezing rollers.

In the embodiment of FIG. 2, the diffuser walls are defined by rotating endless belts 25, each of which rotate together with rollers 15, 16 and are deflected by auxiliary rollers 17, 18. The arrangement of the belts can be seen from FIGS. 4 and 5. It is essential in such a belt arrangement that the outer belt surfaces are completely flush with the roller surface of rollers 15, 16. This is effected by the provision of recesses 26 in the roller surfaces for receipt of the belts.

Figure 3:
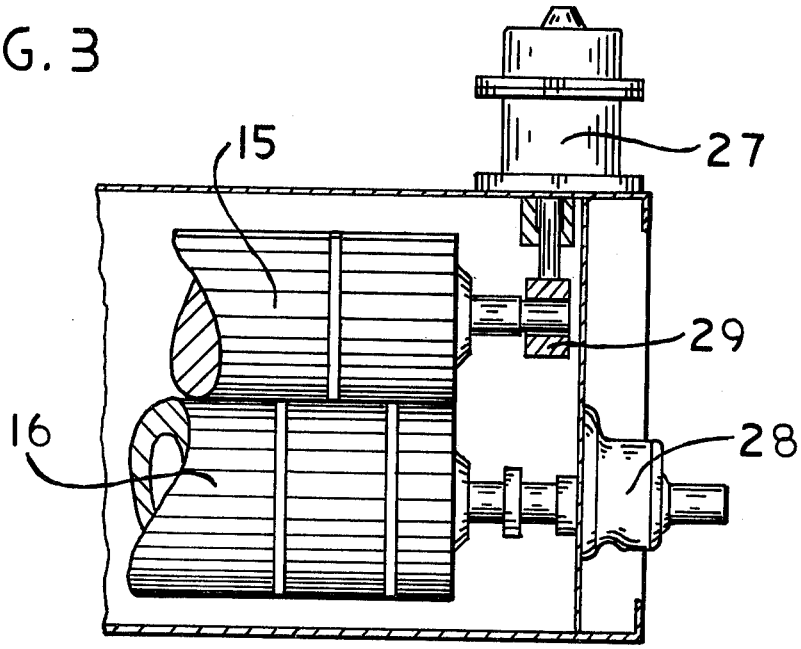
FIG. 3 is a fragmentarilly-illustrated end view of the device shown in FIG. 2, showing the bearing support assembly for the squeeze rollers.

FIG. 3 shows the support means for rollers 13, 14, or 15, 16, respectively. It can be seen that the lower roller 14, 16 is mounted in a fixed position in the housing, by means of a bearing 28 which is disposed outside of the treatment liquid, while the upper roller 13, 15 is mounted on a slide bearing 29 disposed in the trough of the housing. Sliding support 29 is coupled with a pneumatic device 27 which permits pressing of upper support roller 13 or 15 against lower roller 14 or 16, respectively, or, conversely, lessening the pressure by lifting this roller 13 or 15, respectively, from the lower roller.

While several embodiments of the present invention have been shown and described, it will be obvious to those persons of ordinary skill in the art that many changes and modifications may be made thereunto without departing from the spirit and scope of the invention.

What is claimed is:

1. In a device for the continuous treatment of relatively wide textile webs in a treatment medium of the type including a trough having a top open end in which is received a treatment medium and which has squeezing elements associated therewith for intensifying the treatment of the web with the treatment medium and a substantially horizontally oriented funnel-shaped diffusor disposed adjacent to an entrance end of the trough for guiding the web into the trough wherein the web travels in generally the same direction through the trough as the treatment medium in a generally sinuous serpentine independent manner, the improvement comprising:

squeezing means disposed adjacent to said diffuser including a pair of coacting substantially vertically arranged rotatable squeeze rollers which define therebetween a squeezing nip disposed within the trough below the top open end thereof and beneath the surface of the treatment medium and through which the web passes prior to introduction into said diffuser, said nip having an entrance side and a discharge side; and deflection means disposed adjacent to the discharge side of said nip of said rollers for facilitating removal of said web from engagement with the circumferential surface of said rollers and for guiding said web into said diffuser, said diffuser being disposed substantially beneath said surface of the treatment medium and suitably dimensioned and configured to permit the continuous generation of transverse, sinuous, pleated fold portions in the web which fold portions expand in width as they pass through said diffuser.

2. The device according to claim 1, wherein said deflection means are wipers which engage the circumferential surfaces of said rollers, said wipers by being held in engagement with said circumferential surfaces by means of sealing bars.

3. The device according to claim 2, wherein the diffuser has an upper wall and a lower wall each of which has an end portion and wherein the end portions of said walls serve as said wipers.

4. The device according to claim 1, additionally including a pair of auxiliary rotatable rollers, each of which is spaced from and disposed to cooperate with one of said squeeze rollers, and at least one endless belt received about one of said squeeze rollers and its associated auxiliary roller for rotation therewith and at least one endless belt received about the other of said squeeze rollers and its associated auxiliary roller for rotation therewith, and wherein said belts serve as said deflection means.

5. The device according to claim 4, wherein said squeeze rollers are each provided with at least one circumferentially-extending recess in which said at least one belt received thereabout is received, said at least one recess of each of said squeeze rollers being of sufficient depth such that the outer surface of said belt received therein lies flush with the circumferential surface of said squeeze roller about which it is received.

6. The device according to claim 1, wherein said squeeze rollers are disposed vertically, one above the other, and are disposed within a housing and, wherein, the lower squeeze roller is supported on a bearing pin which extends through the housing and is rotatably supported in a first-bearing assembly disposed on the outside of said housing and the upper squeeze roller is supported on a bearing pin which is rotatably supported in a vertically-slidable second bearing assembly disposed in said treatment medium.

7. The device according to claim 6, additionally including pneumatic means for vertically-sliding said second bearing assembly and, in turn, said bearing pin of said upper squeeze roller so as to effect movement of said upper squeeze roller between a contacting and non-contacting position relative to said lower squeeze roller.

8. The device acording to claim 1, additionally including fresh treatment medium supply feeding means disposed immediately following said squeezing means and coupled to said diffuser for facilitately feeding of said web through said trough.

* * * * *